United States Patent [19]

Rohrbaugh

[11] 4,422,208

[45] Dec. 27, 1983

[54] WIRE ROPE CLEANING TOOL

[76] Inventor: Galen V. Rohrbaugh, Rte. 3, Box 98, Oakland, Md. 21550

[21] Appl. No.: 445,822

[22] Filed: Dec. 1, 1982

Related U.S. Application Data

[63] Continuation of Ser. No. 288,017, Jul. 29, 1981, abandoned.

[51] Int. Cl.[3] ..... B08B 1/02; B08B 1/04; B08B 11/00

[52] U.S. Cl. ..... 15/256.6; 15/236 C

[58] Field of Search ..... 134/9; 15/236 A, 236 C, 15/256.6

[56] References Cited

U.S. PATENT DOCUMENTS 3,116,811 1/1964 Stevenson ..... 15/256.6 X
3,999,240 12/1976 Uchida ..... 15/256.6

FOREIGN PATENT DOCUMENTS 858832 1/1961 United Kingdom ..... 15/256.6
759441 9/1980 U.S.S.R. ..... 15/256.6

*Primary Examiner*—Marc L. Caroff

*Attorney, Agent, or Firm*—A. A. Saffitz

[57] ABSTRACT

A wire rope cleaning tool adapted to be used against a bumper or stop which comprises a U-shaped guide for the rope to be cleaned. The tool includes a plurality of pie-shaped segments bolted between two washer-shaped apertured plates with one scraping bit mounted between each pair of segments. The scraping bit consists of hardened plastic formed with an arcuate scraping surface to fit into the helical creases of the rope. The top of the scraping bit has a recess in which a circular tension spring is held. The circular tension spring urges the scraping bits into engagement with the rope. It is preferred to place the cleaning tool in position around the rope next to the bumper which is fixed to an appropriate support close to the sheave wheel near the hoist drum which guides the rope attached to a car or elevator going down the mine shaft. In this position the cleaning tool rotates and removes dirt and grease while the rope is pulled down the track of the car or of the elevator. Between the bumper stop and the tool a washer of an anti-friction material, such as Teflon or Kel-F is used to facilitate the rotation of the cleaning tool.

5 Claims, 8 Drawing Figures

WIRE ROPE CLEANING TOOL

This is a continuation of application Ser. No. 288,017, filed July 29, 1981 now abandoned.

BRIEF DESCRIPTION OF THE PRIOR ART

British Pat. No. 858,832 published Jan. 18, 1961, in the name of David Reekie describes an apparatus for cleaning wire ropes comprising two ligament anchoring members 5 forming the end of cylinder 5*a*, axially extending opposite arms 6, a central opening 7, a sleeve 8 in which the flange of another anchoring member 10 is fitted with a central opening 11. This elongated construction provides aligned gaps 12 at the sides to permit the apparatus to be fitted to a rope. The ligaments 5 and 10 can be tightened to insure uniform tensioning. Scrapers 25 are chisel pointed to engage the helical grooves. The scrapers are formed of hard metal and are set at an angle of 45 degrees. Compression springs 28 between collars 29 press the scraper into the rope. The chisel edge on the metal rods tends to cause the separate helical wires of the rope to be cut or separated unless special care is taken to adjust the tensioning so that the scrapers do not act harshly on the rope. The Brisith patent makes special mention that the scrapers should not act harshly on the rope which requires skillfull application. The apparatus of the British patent contemplates the combination with a pressure lubricator in the form of an outer casing containing lubricant under pressure supplied to the rope while it is passed through the cleaning apparatus and this is particularly described in the last portion of the specification.

U.S. Pat. No. 1,576,159 to G. Timmerman describes an elongated box device for greasing hoisting cable, the box provided with lubricant for oiling the cable in motion.

U.S. Pat. No. 1,584,704 to F. Swan describes a rope guide lubricator of dovetail shape with a lining of non-conducting material for lubricating a rope.

U.S. Pat. No. 1,509,906 to G. G. Sawtelle describes a wire line lubricator of elongated cylindrical construction with openings at top and bottom, wing bolts for closing the split cylinder and special packing means to prevent leakage of the lubricant.

U.S. Pat. No. 3,838,752 to Harry Berkovitz in FIG. 2 describes an automatic lubrication means for elevator cable which is used to maintain the elevator system in good operating condition.

U.S. Reissue Pat. No. 29,493 to Desmond Crump discloses and claims a cable cleaning unit comprising a chamber and a plurality of outlets in the chamber for high pressure fluid jets directed onto the surface of the cable at an inclined angle to the longitudinal axis of the cable being cleaned. This apparatus uses hydraulic pressure under 4000–5000 p.s.i. to remove extraneous matter from the surface of the cable. The fluid is a lubricant.

U.S. Pat. No. 4,046,225 to Walter Shenk shows a special cylindrical collar fitted with a plurality of annular discs and outer rubber seals for applying lubricant to a cable.

Finally, U.S. Pat. No. 2,370,314 to R. B. Jenner in FIG. 3 shows a rope lubricator comprising spaced multi-part internal spirally grooved dies mounted for rotation within a housing through which the rope passes and a pair of semi-circular rings permit the apparatus to be mounted and removed from a rope.

DIFFERENCES OF THE PRESENT INVENTION OVER THE PRIOR ART

In the operation of deep coal mines and similar mines in the eastern part of the United States with which the inventor is very familiar having worked in the mines throughout his lifetime, the safety inspection of mine lift equipment and particularly ropes and cables has become very important to both the mine owner and to the mine worker. Under present rigid standards unannounced inspections are made by the Mine Safety Division of the U.S. Bureau of Mines and by other officials within the State and Federal Governments to assure that all precautions are taken for proper operation on mine lifts, barney cars and mine elevators. If corrosion takes place because of inadequate cleaning, and, if dried up lubricant is imbedded within the strands of the wire rope so as to cause separation and weakening, there is the possibility of failure which is guarded against by frequent inspection and by requiring replacement of any damaged cable.

The use of hardened steel scraping equipment, such as described in British Pat. No. 858,832 runs into the danger mentioned in the patent of cutting the strands or deforming the strands so that a point of weakness is created by use of the cleaning tool itself.

The use of expensive lubricant equipment has its disadvantages. Mainly, either the undesirable use of large amounts of lubricant for cleaning, the disposal of such lubricant after it is used and the inability to properly inspect and examine by eye the condition of each of the strands forming each of the ropes of the wire cable.

Accordingly, there is need for a new approach which is inexpensive and which permits the removal of imbedded dirt between the strands of the rope by simple scraping without damaging, bending or cutting the separate strands forming the rope.

OBJECTS OF THE INVENTION

It is the object of the invention to provide a new scraping means based upon a hard oil resistant low friction plastic, which is formed of an arcuate surface and spring tension to fit into the helical grooves between the adjacent ropes of a wire cable and to be removed by scraping imbedded dirt and grease without requiring the aid of a lubricant either a liquid oil or a grease.

A further object of the invention is to provide a low cost scraping and cleaning means which is made of a synthetic plastic material hard enough to remove imbedded dirt, has anti-friction characteristics but will not damage the separate wire strands making up the rope and can be used independently of any liquid oil or paste grease to permit usual inspection of the cable and thereby assure its safe use for mine operations. Further and other objects of the invention will be apparent from the following detailed description drawings and claims.

SUMMARY OF THE INVENTION

It has been discovered that efficient scraping bits can be cut and shaped from tough, hard, anti-friction synthetic thermoplastics, such as Teflon, tetrafluoroethylene polymer, Kel-F, trifluoroethylene polymer, polypropylene and polycarbonate, these thermoplastics having a Shore D hardness of about 50–60, being resistant to tearing and being hard enough to remove imbedded grime and dirt in the spaces between strands and ropes of the cable. In order to provide a low cost highly efficient dry scraping tool there is assembled a plurality of pie-shaped segments, preferably 6, with two holding washers and each segment is fitted with a hard plastic bit of the material identified possessing the essential anti-friction properties, the hardness sufficient to carry out scraping, the toughness and tear-resistance to prevent shredding by wire strands and the modulus characteristics high enough to prevent the bit from breaking when in use. The segment holding the bit, one bit being provided for each segment is fastened to the outer washers with countersunk screw means and between the two washers there is fitted a circular spring in the space provided in the bit for such spring whereby each of the bits is tensioned inwardly with the arcuate scraping surface fitted into the helical space between adjacent ropes of the cable. The washer-segment-bit assembly rotates as a single unit when the rope passes through the central openings of the washers between the bits.

A preferred simple position for the wire rope cleaning tool is adjacent to the hoist drum of the cable or wire rope which is attached to the barney car on tracks or to an elevator going down the mine shaft.

The tool is used with a bumper or stop which is separated by a washer of anti-friction material, such as Teflon on Kel-F to permit the tool with its scraper edges in the helical creases to rotate as the rope is pulled through the tool. In this manner wire cable exposed to very dirty and dusty conditions in the mines, and in particular in coal mines, can be effectively and efficiently cleaned, the cleaning verified by simple usual inspection and compliance with Mine Safety regulations, both Federal regulations and State regulations assured. This inspection by Federal and State officials is facilitated. Any break in the wire quickly noted and the cable replaced as required without unacceptable delay. Rough handling of the wire rope, which occurs every day, may be monitored more carefully and proper maintenance and safety assured.

It is important to distinguish between the scraping tool of the invention and a Teflon flexible spatula or flexible rubber doctor blade or a rubber blade. The Teflon or rubber blade has no special arcuate shape coming to a hard edge which wedges into the helical space between ropes, and in particular, does not have one such edge with an opposing same stiff edge on the other side of the rope as in the invention. The scraping function is surprisingly efficient without any risk of damage to the wire strands.

DESCRIPTION OF THE PREFERRED EMBODIMENT

Figure 1:
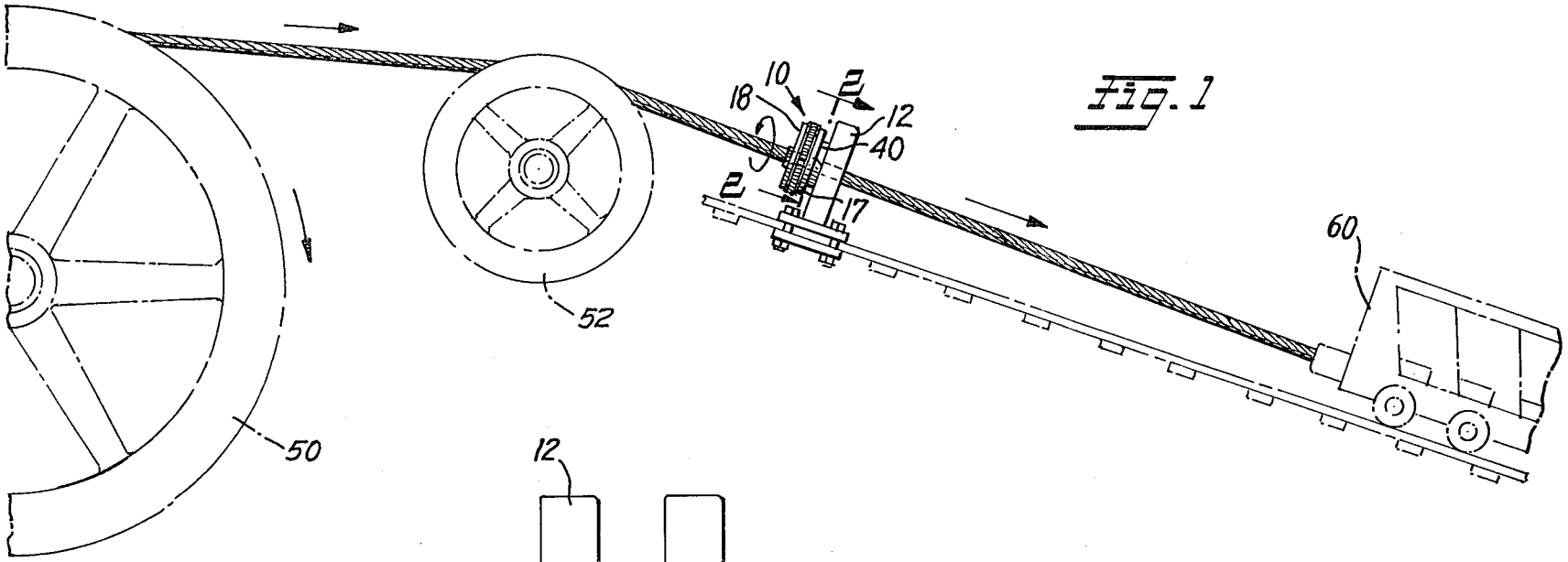
FIG. 1 is a sectional view showing the use of the wire rope cleaning tool with a washer and a bumper stop in a preferred placement of the tool relative to a drum and a sheave over which the cable passes.

The wire rope cleaning tool of the invention 10 as shown best in the FIGS. 3–8 of the drawing has a body portion comprising two washers, which in the specific embodiment illustrated are each ½ inch in thickness, and of low carbon steel which are illustrated as reference numeral 17 for the right outside washer and reference numeral 18 for the left outside washer.

Figure 5:
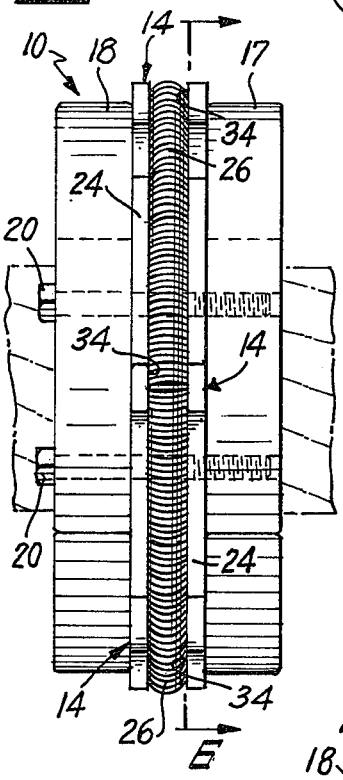
FIG. 5 is an elevational view of the wire rope cleaner similar to that in FIG. 3 but enlarged to show details more clearly.

Segments 24, each being pie-shaped are held between the right washer 17 and the left washer 18, as shown in FIG. 5, by means of fastening means 28 in the form of countersunk screws which secure each segment to the tapped bore in the washer, each threaded bore identified by reference numeral 22.

Each segment 24, there being 6 in all, holds an anti-friction high modulus, thermoplastic bit 14 which scrapes, in dry fashion, away the dirt, grime and old lubricant in the helical spaces. The edge 32 of the bit 14 is stiff and hard and the arcuate side of the edge as seen in FIG. 5 of the drawing are curved to closely fit a single rope of the cable, there being an opposing edge 32 of an opposite bit 14 at the opposite side of the cable, just 180° away.

The bits vary in size in accordance with the diameter and multiple rope structure of the wire cable.

The Metals Handbook, Ninth Edition, Volume 1, entitled "Properties and Selection of Iron and Steel" which is published by the American Society for Metals, at Metals Park, Ohio 44073, describes the commercially available cables as being composed of wires having a tensile strength ranging from 590 to about 1930 MPa which corresponds to 85–200 Ksi. These cables are formed in diameters which may be as small as 1/16" and go up to 7" in size.

A circular spring 26 rests in the space between washers 17 and 18 and inside of each channel 34 at the top of the bits so that the one spring presses all of the bits 14 against the cable. To facilitate assembly and disassembly of the tool and bit assembly in fastened condition, the washer assembly is cut on a diameter at a location away from the countersunk screw fastening means 20,22 to thereby split the assembly into two semicircular disc assemblies, after removal of the spring, and staggered retaining bolts are provided to make each semicircular assembly a unit half assembly thus facilitating mounting the tool assembly or dismantling the assembly by insertion or removal of these staggered through bolts.

Figure 7:
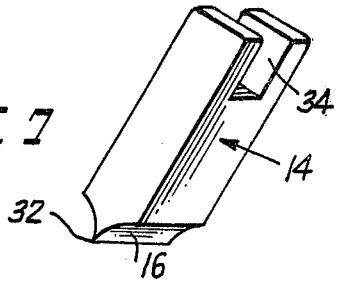
FIG. 7 is a perspective view of a single cleaning bit.
Figure 4:
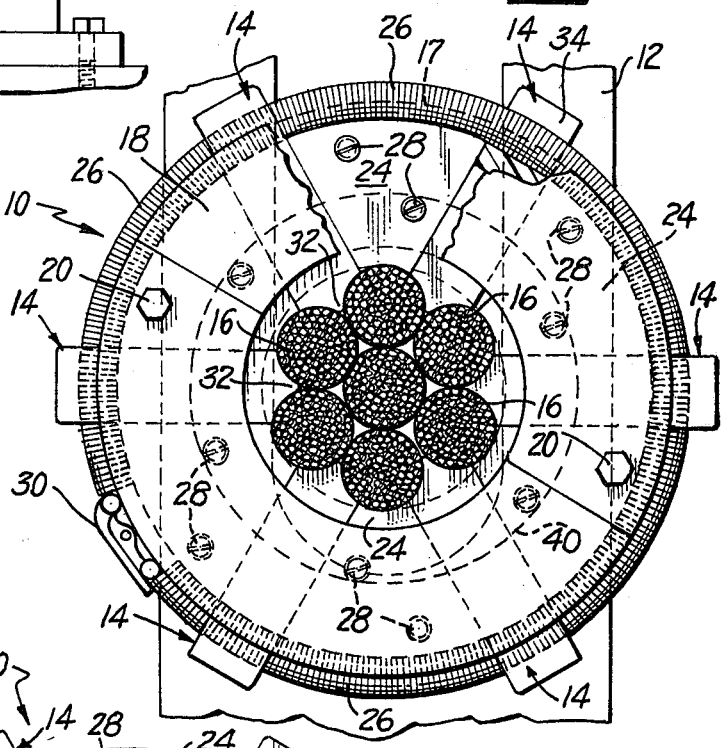
FIG. 4 is an enlarged side view partly in section taken on the line 4—4 of FIG. 3.

Turning now to the assembly of the pie-shaped segments 24 as illustrated in the completely assembled condition in FIG. 4 with the bits in scraping condition between the wire ropes, it should be noted that the scraping edge of the bits 14 designated as 32 in FIG. 7 is cut with a milling machine router in such fashion as to provide a slight upward tilt at edge 32 of the type which is had in a screw thread so there will be exerted by the tip 32 a positive scraping pressure under the force of the circular tension spring 26. Immediately opposite the bit which is at the nine o'clock position in FIG. 4 there is the corresponding bit 14 at the three o'clock position and the horizontal access passing through both of these bits also passes through both tips which are diametrically opposed to each other on opposite sides of the cable. In the configuration shown in FIG. 4 with clamp 30 closed, diametric opposites of the bits are also shown in the pair of bits at one o'clock and seven o'clock positions and also in the pair of bits at the eleven o'clock and the five o'clock positions.

It is within the contemplation of the invention to use three bits instead of six bits in which case the bits would not be diametrically opposed. However, if four bits were used then the bits would be diametrically opposed. In that configuration, the four bits would occupy the three o'clock and nine o'clock positions for one pair of opposed bits and the six o'clock and twelve o'clock positions for the other pair of opposed bits. In the case where a fewer number of bits than is shown in FIG. 4, namely, where six bits are shown, then it is within the contemplation of the invention to run the cable through twice and reposition the tool between successive scrapings so that all of the interhelical spaces are scraped by the arcuate surfaces 16 and the tip 32.

Figure 6:
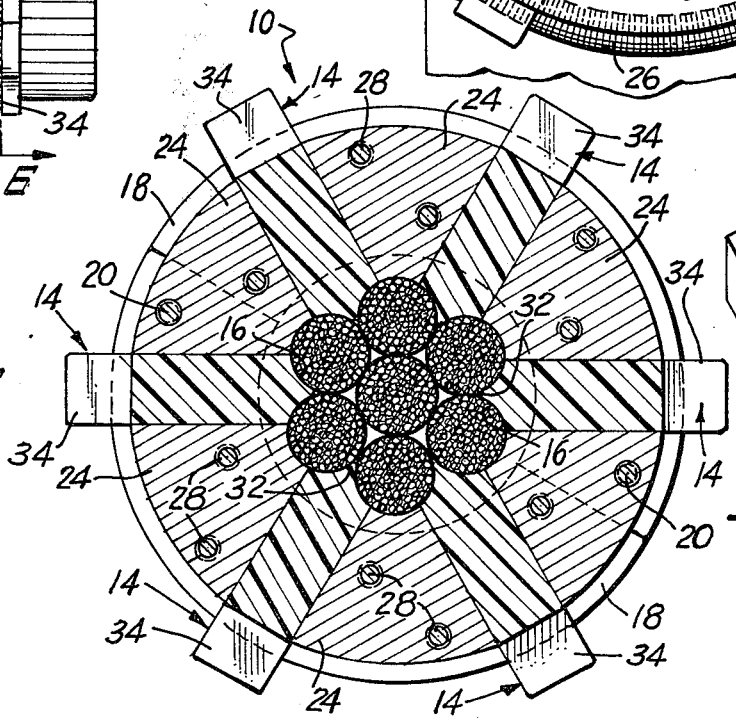
FIG. 6 is a vertical sectional view taken on the line 6—6 of FIG. 5.
Figure 8:
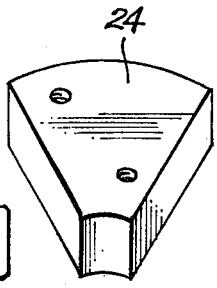
FIG. 8 is a perspective view of one of the segmental spacers of the invention.

In the assembly of the preferred embodiment the pie-shaped segments 24 are attached to the right and left washers through the threaded bores and with bolt means 28 as seen in FIG. 6. These segmented spacers provide the framework between which the six bits 14 are placed with the channel 34 open at the circular periphery of the washer plate so that the channel 34 serves as the recess for the circular spring 26. The circular spring 26 is widened for assembly by opening the clamp 30, slipping it about each of the six bits 14 through each channel 34 therein and thereafter closing the clamp 30 to bring the circular spring in tension condition against eh bit thereby forcing the edge 32 into the inter-helical space of the cable.

From the foregoing it is readily seen that the assembly of the tool requires the simple steps of setting up the segments and bolting them to the washer plates, inserting the individual bits in the six spaces produced thereby and threading the circular spring through the channels 34 in each bit to define the circular tensioning means for the scraping position of the tool, the simple clamp 30 serving to expand the spring for dismantling the tool and to tension the spring to bring it into proper scraping relation after the tool is applied.

Figure 2:
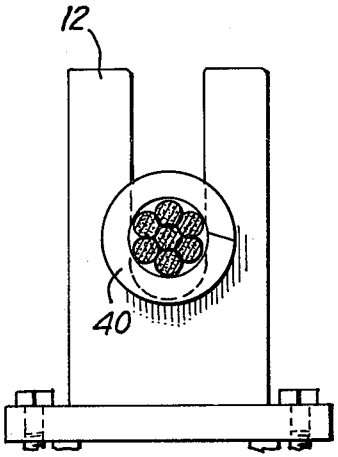
FIG. 2 is a side elevational view showing the placement of the cable and washer relative to the bumper stop.
Figure 3:
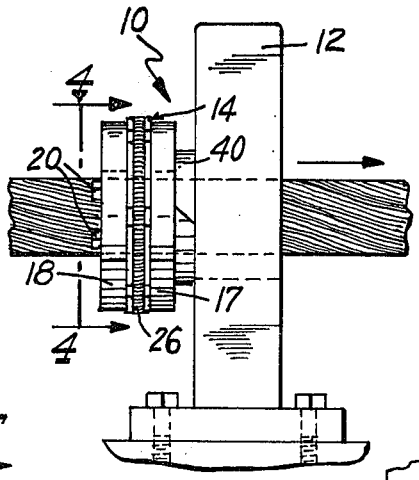
FIG. 3 is an end elevational view of the wire rope cleaner of the present invention.

In the preferred installation of the cleaning tool as shown in FIGS. 1 and 2 a bumper stop means 12 is used as a stationary anchor against which the tool works, next to sheave 52.

Wire ropes such as used on coal mine slope and shaft hoist must be lubricated often to prevent rust, corrosion and wear.

After the ropes have been used and lubricated for a period of time they tend to get a buildup of dried grease and dirt.

Men are transported on the hoist and the ropes must be inspected daily by the operator and periodically by Mine Safety Inspectors. The grease and dirt built up on the rope make a good inspection very difficult or impossible.

The rope cleaner which I have manufactured removes all the old grease and dirt from the rope, permitting a much better examination to be made.

After the rope has been properly cleaned and inspected it is necessary to apply new lubricant; this is done by one of the many methods now in use. The cleaned rope lets the new lubricant penetrate into the center of the rope therefore thoroughly lubricating the rope. The properly cleaned and lubricated rope now protects it from rust and corrosion and allows a proper inspection to be made daily. The process must be repeated again when rope becomes dirty and coated with dry grease.

The cleaning tool which I have designed is different from other cleaners in the use of Teflon, polypropylene, or other suitable hard plastics for cleaning pins to remove the grease and dirt.

The Teflon, polypropylene or polycarbonate plastic bit cleans more thoroughly and will not damage the rope. The Mine Safety Hazard Administration Inspectors do not like the use of steel or other hard metals used on wire ropes where men are being transported.

The wire cleaner is also different and unique by using a Teflon thrust washer 40 as a bearing with the guide 12. This permits the tool to be light in weight, and can be used in almost any location along the rope. However, the preferred location is next to the drum 50 as shown in FIG. 1 so that the rope can be scraped next to sheave wheel 52 before the point of attachment to the Barney car 60 which goes down the track and is held by the rope.

Having thus disclosed the invention, I claim:

1. A wire rope cleaning tool combined with a bumper stop means having a U-shaped guide for the rope to be cleaned and an anti-friction thrust washer located between said U-shaped guide and the wire rope cleaning tool, said tool comprising:

a pair of apertured side plates in the shape of a washer, one for the right hand and the other for the left hand side of the rope, the rope passing through the circular aperture of said plates, a plurality of pie-shaped segments each of which is secured to the plates by two bolt means, one bolt means in each segment provided for one of said pair of plates and the other bolt means for the other of said pair of plates, said plurality of segments providing alternating spaces between adjacent segments for inserting and holding there between a hardened plastic scraping bit there being one scraping bit for each helical junction in a cross-section of the rope, a plurality of scraping bits, each scraping bit consisting of a rectangular body of hardened plastic formed with rectangular sides and at its bottom with a V-shaped arcuate scraping surface and a sharp edge at the vertex of the V which fits into a helical junction of the rope to scrape the junction free from dirt and grease with each scraping bit being formed at its top with a channel adapted to hold a circular tension spring within the channel after the plurality of bits are mounted in circular array with the rectangular sides held between the alternating spaces between said plates, a circular tension spring which fits over the top of the plurality of segments mounted between said plates and into the channel portion within the sides of the channel portion of each of the bits, said tension spring urging the bits into radial pressing engagement with the rope for scraping the helical junctions of the rope, and a closing and opening clamp which is fitted between the ends of said circular tension spring and is adapted to expand and open the spring when said clamp is opened and adapted to tension and tighten the spring when said clamp is closed to force the V-edge of the bits into the helical junctions of the rope for scraping away dirt and grease.

2. A wire rope cleaning tool as claimed in claim 1 wherein there are provided six segments defining six intersegmental spaces and said spaces are occupied by six scraping bits.

3. A wire rope cleaning tool as claimed in claim 2 wherein said bits are composed of high modulus tetrafluoroethylene polymer having a hardness on the Shore D scale of about 50.

4. A wire rope cleaning tool as claimed in claim 2 wherein said bits are composed of high modulus polycarbonate resin.

5. A wire rope cleaning tool as claimed in claim 2 wherein said bits are composed of high modulus polypropylene.

* * * * *